US008176700B2

(12) United States Patent
Butcher, Jr. et al.

(10) Patent No.: US 8,176,700 B2
(45) Date of Patent: May 15, 2012

(54) CLIP-ON EXTRUDED MOLDINGS FOR CEILING GRID

(75) Inventors: William V. Butcher, Jr., Falling Waters, MD (US); Steven K. Itnyre, Hagerstown, MD (US); Kevin R. Albright, Flintstone, MD (US); Richard B. Jacobs, Asbury, NJ (US)

(73) Assignee: Eaton Corporation, Cleveland, OH (US)

( * ) Notice: Subject to any disclaimer, the term of this patent is extended or adjusted under 35 U.S.C. 154(b) by 43 days.

(21) Appl. No.: 12/755,871

(22) Filed: Apr. 7, 2010

(65) Prior Publication Data

US 2011/0247284 A1 Oct. 13, 2011

(51) Int. Cl.
*F27D 1/00* (2006.01)

(52) U.S. Cl. ..... 52/506.07; 52/311.3; 52/716.1

(58) Field of Classification Search ..... 52/506.07, 52/717.05, 716.1, DIG. 8, 311, 311.3, 220.6, 52/506.06, 506.08–506.09
See application file for complete search history.

(56) References Cited

U.S. PATENT DOCUMENTS

| | | | | |
|---|---|---|---|---|
| 3,594,972 | A | 7/1971 | Jones et al. | |
| 4,055,930 | A | 11/1977 | Weinar et al. | |
| 4,117,641 | A | 10/1978 | Wells | |
| 4,452,021 | A | 6/1984 | Anderson | |
| 4,742,662 | A | 5/1988 | Smith | |
| 4,848,054 | A | 7/1989 | Blitzer et al. | |
| 4,926,606 | A | 5/1990 | Hanson | |
| 5,253,462 | A * | 10/1993 | Blitzer et al. | 52/506.07 |
| 5,421,132 | A * | 6/1995 | Bischel et al. | 52/311.3 |
| 5,495,697 | A | 3/1996 | Bischel et al. | |
| 5,609,007 | A | 3/1997 | Eichner | |
| 5,979,134 | A | 11/1999 | Neff | |
| 6,408,589 | B1 * | 6/2002 | Bousquet | 52/714 |
| 6,536,173 | B2 | 3/2003 | Rebman | |
| 7,278,243 | B2 | 10/2007 | Jones et al. | |
| 7,392,629 | B1 * | 7/2008 | Bankston et al. | 52/506.07 |

FOREIGN PATENT DOCUMENTS

DE 195 09 127 9/1995

OTHER PUBLICATIONS

International Search Report for PCT/IB2011/000742 mailed Sep. 27, 2011, pp. 1-5.
Written Opinion of the International Searching Authority for PCT/IB2011/000742 mailed Sep. 27, 2011, pp. 1-8.

* cited by examiner

*Primary Examiner* — William Gilbert
*Assistant Examiner* — Gisele Ford
(74) *Attorney, Agent, or Firm* — Mei & Mark LLP

(57) ABSTRACT

A molding system conceals gridwork in suspended ceilings. A main or cross piece molding comprises two opposed clip assemblies for attaching to inverted T-bars. The clip assemblies comprise a vertical portion. Upper and lower fingers protrude horizontally from the vertical portion and towards the opposed clip assembly. Upward projecting arms extend from upper edges of the vertical portions and have upward edges. Horizontal arms extend from the upward edges and extend away from the clip assemblies. A decorative portion spans between distal ends of the horizontal arms. A perimeter molding for attaching to L-bars comprises a first horizontal arm configured to abut a lower portion of a horizontal surface and a second horizontal arm that is parallel to the first horizontal arm. First and second legs connect to the second horizontal arm. The second leg abuts an upper, distal portion of the horizontal surface near a hem.

22 Claims, 7 Drawing Sheets

CLIP-ON EXTRUDED MOLDINGS FOR CEILING GRID

TECHNICAL FIELD

The present disclosure relates generally to decorative moldings for drop ceiling grids.

BACKGROUND

Current drop ceilings can comprise a series of interconnected supports for installing acoustic, insulating, or decorative tiles. The gridwork for suspended ceilings may comprise L-bars anchored to walls around a ceiling perimeter. T-bars may be suspended from anchors to extend latitudinally and longitudinally with respect to each other to create a grid. The L-bars and T-bars cooperate by overlapping and/or interlocking to provide support for tiles.

Many configurations of hardware are possible, including a system of main runners, cross grids, and perimeter wall runner grids, such as a system marketed by Armstrong World Industries.

Since the L-bars and T-bars are largely functional, their appearance can be characterized as plain or industrial. In addition, since the L-bars and T-bars tend to be metal, paint coatings can be marred during installation. Therefore, various prior art designs provide for interlocking tiles or other decorative means for concealing the L-bars and T-bars.

SUMMARY

In one embodiment, a clip-on molding for concealing gridwork in suspended ceilings may comprise two opposed clip assemblies. Each clip assembly comprises a vertical portion having a lower edge and an upper edge and a lower finger protruding horizontally from the lower edge of the vertical portion and towards the opposed clip assembly. An upper finger protrudes horizontally from the vertical portion and towards the opposed clip assembly. Upward projecting arms extend from the upper edges of the vertical portions, the upward projecting arms having upward edges. Horizontal arms extend from the upward edges of the upward projecting arms, and the horizontal arms extend away from the clip assemblies and have distal ends. A decorative portion spans between distal ends of the horizontal arms. The lower surfaces of the upper fingers may be parallel to the upper surfaces of the lower fingers, thereby forming grooves. The grooves may be configured to accept opposed edges of gridwork.

In yet another embodiment, a snap-on molding may conceal perimeter gridwork in suspended ceilings. A first horizontal arm may abut a lower portion of a horizontal surface. A second horizontal arm may be parallel to the first horizontal arm. A first leg may connect to a first end of the second horizontal arm. A second leg may connect to a second end of the second horizontal arm, with the second leg configured to abut an upper, distal portion of the horizontal surface near a hem on the horizontal surface. Serially connected connecting arms may span between an upper end of the second leg to an end of the first horizontal arm.

A molding system may conceal peripherally, longitudinally and/or laterally extending gridwork in suspended ceilings. The system may comprise at least one clip-on molding and at least one snap-on molding.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DETAILED DESCRIPTION

Reference will now be made in detail to the present exemplary embodiments, examples of which are illustrated in the accompanying drawings. Wherever possible, the same reference numbers will be used throughout the drawings to refer to the same or like parts.

In an effort to provide a lightweight and easily installed molding for concealing L-bars and T-bars, proposed herein is a clip-on extruded molding system. The system provides for a perimeter molding that can attach to L-bars and also provides cooperating main and cross piece moldings that can attach to the T-bars. The moldings abut one another to provide a substantially unitary appearance.

Since the proposed moldings are one-piece and clip-on in nature, it reduces the material content greatly over the prior art, resulting in a thin and lightweight product. Since the material can be uniform in composition in some embodiments, nicks and scratches in the molding are not as readily visible as they would be on powder-coated metal hardware. The design also eliminates the need for associated metal clips, magnetic or other tapes, or adhesives, thereby making installation simple. The one-piece design also reduces fabrication costs and time to market.

Figure 1B:
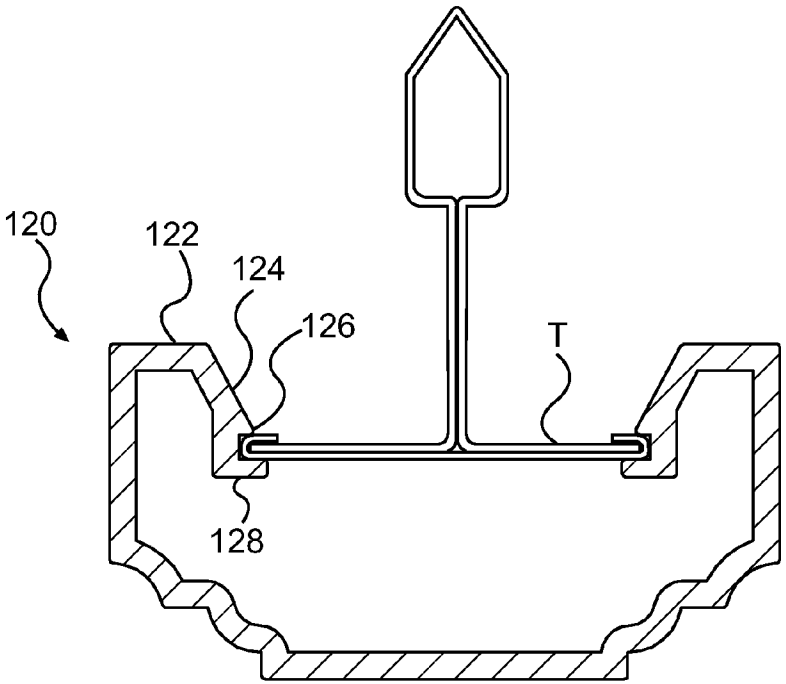
FIG. 1B is an alternate example of a front-view profile of a main or cross piece molding according to a second embodiment of the invention.
Figure 1A:
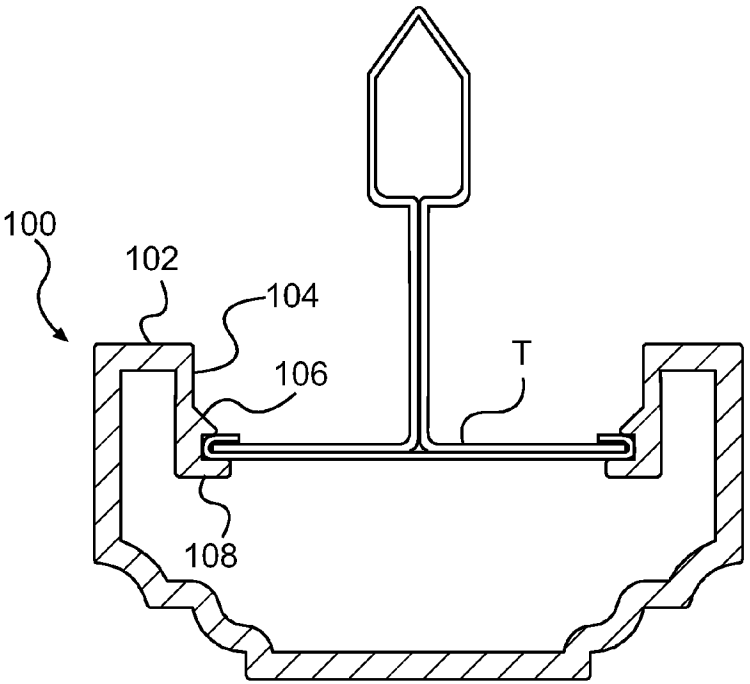
FIG. 1A is an example of a front-view profile of a main or cross piece molding according to one embodiment of the invention.

FIG. 1A shows an example of a profile 100 for a main or cross piece molding for attaching to a non-limiting example of a T-bar T. The example of a T-bar T, as shown, has a horizontal portion, a vertical portion, and a hollow portion. Hollow portion facilitates hanging the T-bar T from hangers anchored to the portion of the ceiling to be concealed. The vertical portion comprises a distance that allows sufficient room for positioning a tile in the grid. Horizontal portion traditionally supports a tile, but as shown in FIG. 1A, horizontal portion is clip-fit to decorative molding 100, and decorative molding 100 supports a tile on upper edge 102.

The profile 100 may comprise a first side and an opposite side. The first side comprises a clip assembly. The clip assembly may comprise a groove between a first finger 108 and a second finger 106. First finger 108 and second finger 106 are integrally formed with a vertical surface 104. Second finger 106 may have a triangular tab shape to assist with the alignment of T-bar T with the groove. The T-bar T may slide along the triangular tab shape of second finger 106, thereby facilitating a snap-fit with T-bar T. The triangular tab shape also creates a strong grip on the T-bar since the material comprising the triangular tab shape prevents the finger from flexing.

Vertical surface 104 is a sufficient distance from upper edge 102 to provide space for the formation of the triangular tab shaped second finger. The vertical distance also enables a pressure-enhanced grip on T-bar T by transferring pressure exerted on upper edge 102 towards the clip assembly, thereby forcing clip assembly towards T-bar T. Upper edge 102 may receive a pressure load from the weight of tiles placed upon it. In addition, the molding may be designed to accommodate up to three tensile pounds without losing the grip capacity of the clip assembly.

The opposite side of profile 100 mirrors the first side, with a clip assembly, vertical surface and upper edge. The first side and opposite side are connected by a section of material that may comprise any one of a number of decorative designs which may include, for example, one or more ogees, bullnoses, roundovers, squares, semi-circles, groove patterns, chamfers, coves, rabbets, or flutings.

FIG. 1B shows an alternate profile 120 for a main or cross piece decorative molding. The molding grips T-bar T with a clip assembly comprising a groove, lower finger 128 and upper finger 126. Upper finger 126 is integral with a diagonal surface 124. The triangular tab shape of upper finger 126 transitions seamlessly to a surface of diagonal surface 124.

The combination of the diagonal surface and the triangular tab shape assists with the alignment of T-bar T with the groove. The T-bar T may slide along diagonal surface 124, along the triangular tab shape of upper finger 126, and into the groove, thereby facilitating a snap-fit with T-bar T. The triangular tab shape also creates a strong grip on the T-bar since the material comprising the triangular tab shape prevents the finger from flexing.

Vertical surface 124 is a sufficient distance from an upper edge 122 to provide space for the formation of the triangular tab shaped second finger. The vertical distance also enables a pressure-enhanced grip on T-bar T by transferring pressure exerted on upper edge 122 towards the clip assembly, thereby forcing clip assembly towards T-bar T. Upper edge 122 may receive a pressure load from the weight of tiles placed upon it. In addition, the molding is designed to accommodate up to three tensile pounds without losing the grip capacity of the clip assembly.

The opposite side of profile 120 mirrors the first side, with a clip assembly, vertical surface and upper edge. The first side and opposite side are connected by a section of material that may comprise any one of a number of decorative designs which may include, for example, one or more ogees, bullnoses, roundovers, squares, semi-circles, groove patterns, chamfers, coves, rabbets, or flutings. An exemplary molding pattern is shown in FIG. 1B, and is used throughout the disclosure for consistency.

Turning now to FIGS. 2A-2D, alternative designs for perimeter profiles are shown. The perimeter profiles allow for a cohesive design throughout a ceiling assembly by providing a vertical distance between an L-bar and a ceiling tile that will comport with a vertical distance created between a T-bar and a ceiling tile. The exterior design of the perimeter profiles also allows for a smooth transition between cross-piece moldings and the perimeter of a room, as will be discussed in more detail below in reference to FIG. 7.

A first perimeter profile 200 is shown attached to an L-bar L. The components of first perimeter profile 200 cooperate to exert pressure on a horizontal portion of L-bar L and to receive a hem H in a way that prevents the profile from slipping off of L-bar L.

A first vertical arm 202 contacts a first horizontal portion of L-bar L and connects to a first horizontal arm 204. Second vertical arm 206 extends downward from first horizontal arm 204 and contacts a second horizontal portion of L-bar L. Vertical side 207 connects first horizontal arm 204 with a second horizontal arm 208. Third vertical arm 210 extends towards second vertical arm 206 and contacts an opposite side of second horizontal portion of L-bar L. Second vertical arm 206 and third vertical arm 210 together cooperate to exert pressure on the second horizontal portion of L-bar L. Second vertical arm 206 and third vertical arm 210 also allow hem H of L-bar L to pass between them during installation and cooperate to prevent hem H from passing backwards out of the decorative molding. This cooperation secures a molding using the design of first perimeter profile 200 to a ceiling perimeter.

Second horizontal arm 208 also connects to fourth vertical arm 212, which connects to third horizontal arm 214. Third horizontal arm 214 abuts a horizontal length of L-bar L, including an opposite side of first horizontal portion of L-bar L. First vertical arm 202 and third horizontal arm 214 cooperate to press against L-bar L, thereby assisting with securing a molding using the design of first perimeter profile 200 to a ceiling perimeter.

The weight of a tile bearing down on first horizontal arm 204 also assists with providing pressure to press first vertical arm 202 and second vertical arm 206 against the L-bar L. When the molding is mounted, fourth vertical arm 212 abuts a wall thereby providing counter support to third horizontal arm 214.

Figure 2A:
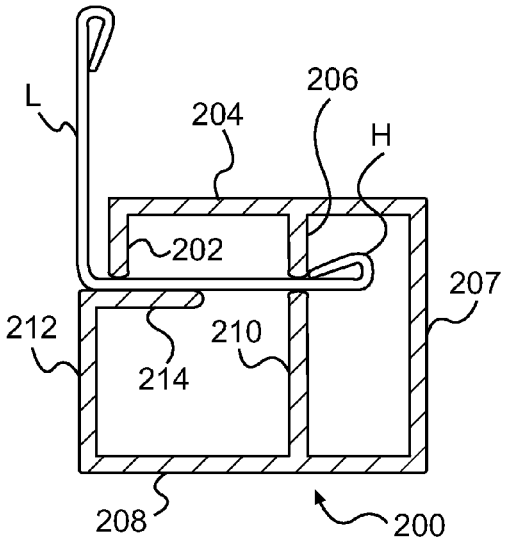
FIG. 2A is an example of a front-view profile of a perimeter molding according to a third embodiment of the invention.
Figure 2B:
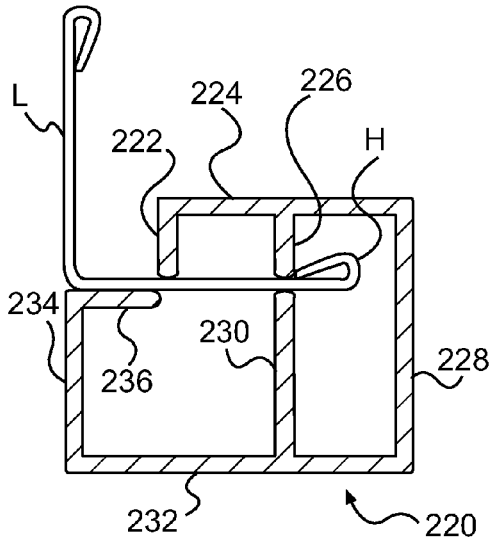
FIG. 2B is an example of a front-view profile of a perimeter molding according to a fourth embodiment of the invention.

FIG. 2B shows an example of a second profile for a perimeter molding. First vertical arm 222 connects to first horizontal arm 224. Second vertical arm 226 extends downward from first horizontal arm 224. Vertical side 228 spans between first horizontal arm 224 and second horizontal arm 232. Third vertical arm 230 and fourth vertical arm 234 extend upward from second horizontal arm 232. Third horizontal arm 236 connects to fourth vertical arm.

First vertical arm 222 cooperates with third horizontal arm 236 to hold a portion of L-bar L. Third horizontal arm 236 can abut a horizontal distance of L-bar L.

Second vertical arm 226 and third vertical arm 230 extend towards each other to exert pressure on a second horizontal portion of L-bar L. Second vertical arm 226 and third vertical arm 230 also allow hem H of L-bar L to pass between them during installation and cooperate to prevent hem H from passing backwards out of the molding. The cooperation of first, second, and third vertical arms 222, 226, and 230, and third horizontal arm 236 secures a molding using the design of second perimeter profile 220 to a ceiling perimeter.

The weight of a tile bearing down on first horizontal arm 224 also assists with providing pressure to press first vertical arm 222 and second vertical arm 226 against the L-bar L.

Figure 2C:
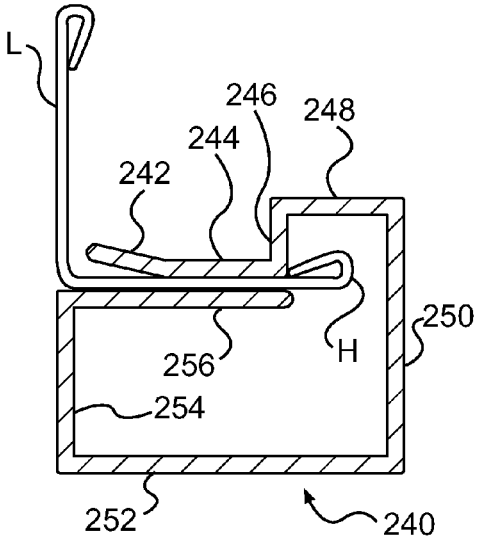
FIG. 2C is an example of a front-view profile of a perimeter molding according to a fifth embodiment of the invention.

FIG. 2C shows an example of a third profile for a perimeter molding. A diagonal arm 242 extends at an angle away from first horizontal arm 244, which connects to vertical arm 246. Vertical arm 246 connects to second horizontal arm 248 which connects to vertical side 250. Third horizontal arm 252 spans between vertical side 250 and second vertical arm 254. Fourth horizontal arm 256 connects to second vertical arm 254. Fourth horizontal arm 256 and first horizontal arm 244 may abut opposing horizontal surfaces of L-bar L and together may exert sufficient pressure on L-bar L to secure a perimeter molding to an L-bar. First horizontal arm 244, first vertical arm 246, and third horizontal arm 256 also cooperate to form a snap fit. The snap fit allows hem H of L-bar L to pass into the interior of the molding during installation while preventing hem H from passing backwards out of the molding.

Diagonal arm 242 provides a means for lifting first horizontal arm 244 and first vertical arm 246 a sufficient distance away from third horizontal arm 256 to permit hem H to exit the decorative molding.

Pressure caused by the weight of a tile bearing down on second horizontal arm 248 transfers to press first vertical arm 246 and first horizontal arm 244 against the L-bar L. When the molding is mounted, second vertical arm 254 abuts a wall thereby providing counter support to fourth horizontal arm 256.

Figure 2D:
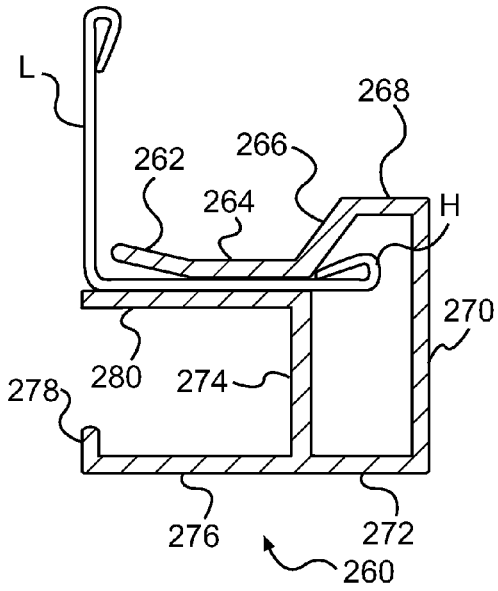
FIG. 2D is an example of a front-view profile of a perimeter molding according to a sixth embodiment of the invention.

FIG. 2D shows an example of a fourth profile for a perimeter molding. A diagonal arm 262 extends at an angle away from first horizontal arm 264. A diagonal arm 266 extends at an opposite angle away from first horizontal arm 264. Second horizontal arm 268 spans between second diagonal arm 266 and vertical side 270. Third horizontal arm 272 spans between vertical side 270 and first vertical arm 274. A fourth horizontal arm 276 connects to second vertical arm 278 and to first vertical arm 274. Fifth horizontal arm 280 also connects to an upper portion of first vertical arm 274.

First horizontal arm 264, fifth horizontal arm 280, first vertical arm 274, and diagonal arm 266 cooperate to form a snap fit. The snap fit allows hem H of L-bar L to pass into the interior of the molding during installation while preventing hem H from passing backwards out of the decorative molding. First horizontal arm 264 and fifth horizontal arm 280 also press against opposing surfaces of L-bar L to provide a secure and stable connection of a molding to L-bar L.

Diagonal arm 262 provides a means for lifting first horizontal arm 264 and diagonal arm 266 a sufficient distance away from fifth horizontal arm 280 to permit hem H to exit the molding.

Pressure caused by the weight of a tile bearing down on second horizontal arm 268 transfers to press diagonal arm 266 and first horizontal arm 264 against the L-bar L.

Figure 3:
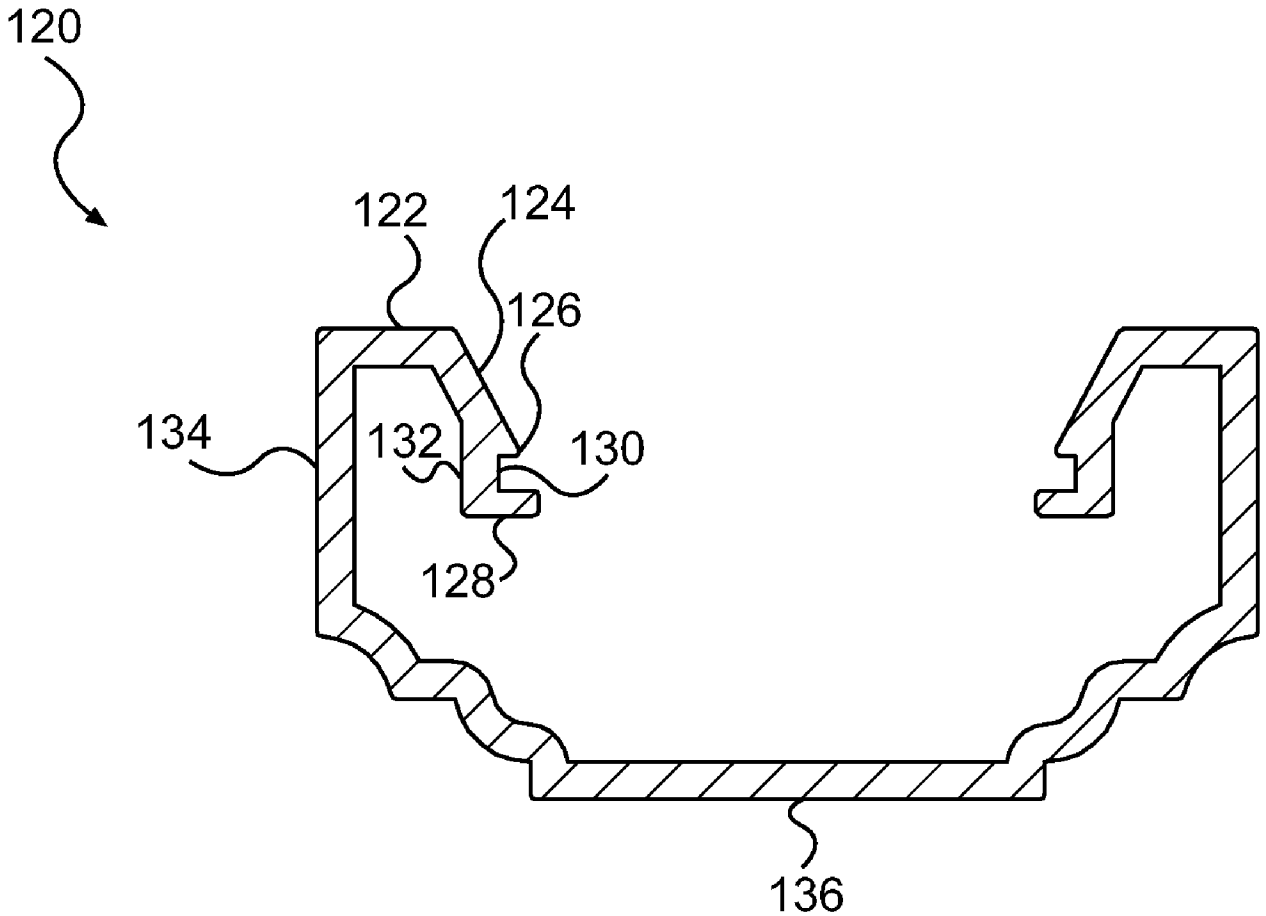
FIG. 3 is an enlarged example of a front-view profile of a main or cross piece molding shown in FIG. 1B.

FIG. 3 provides a front view for a main or cross-piece molding profile 120 of FIG. 1B. Lower finger 128, groove 130, and upper finger 126 share a common rear segment 132. Rear segment 132 is shown as vertical, but may also be at an incline.

FIG. 3 also shows a side edge 134 and a bottom edge 136 connected by a decorative pattern. The shape of the side edge 134, decorative pattern, and bottom edge 136 may vary with aesthetics. However, the vertical distance of the combination, including upper edge 122, comports with the vertical distance of the vertical sides 207, 228, 250, and 270 of the perimeter moldings so that the main and cross piece moldings can aesthetically abut the perimeter moldings while also maintaining a substantially uniform ceiling height.

Figure 4:
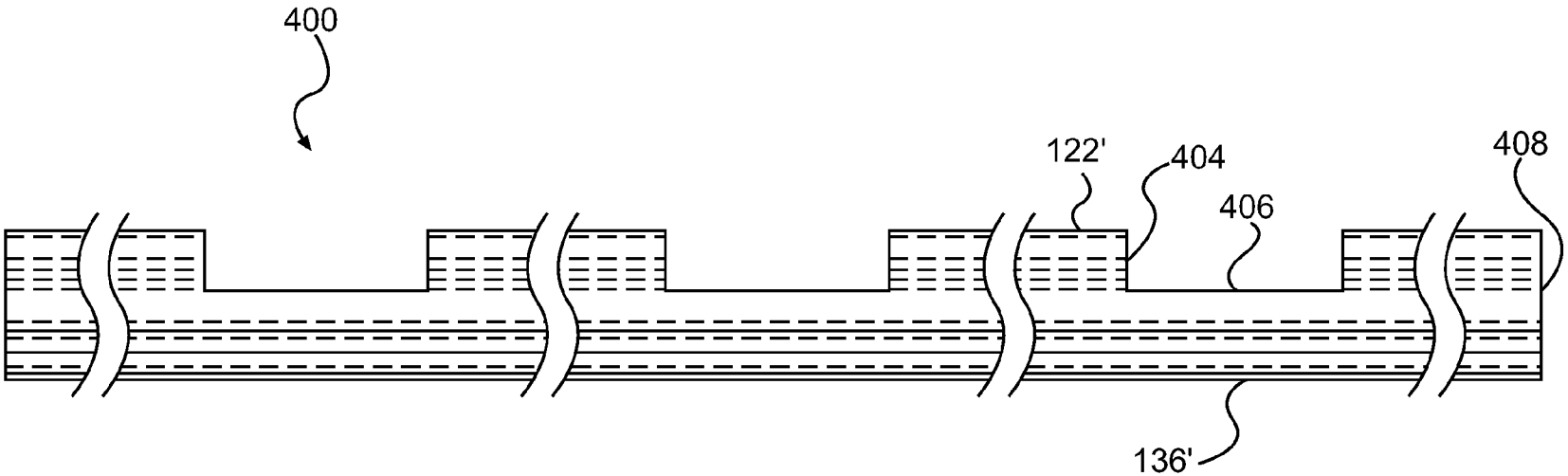
FIG. 4 is a side view of a main piece molding.

FIG. 4 shows a side view of a main molding piece 400. The main molding piece 400 may be approximately six feet in length. When a standard size ceiling tile is used in a drop ceiling design, notches 406 or rabbets should be placed along the length of the upper edge 122' of the main molding piece at sufficient distances to accommodate the overlap areas of main runners and cross T grids. The depth of notches 406 should be sufficient to accept the overlap areas without affecting the grip of the clip assembly. The notches may be formed, for example, by a dado blade.

As one non-limiting example, the main piece molding may have the following dimensions so as to accommodate standard two foot by two foot tiles. The material thickness may be 0.060+/−0.005 inches. The depth of the notch along notch wall 404 may be approximately 0.300 inches. First notches may be approximately 11.438 inches from opposing ends of the six foot length. At least one additional notch may be spaced 22.875 inches away from the inner ends of the first notches, while the notches may be 1.125 inches in width. A reasonable engineering tolerance of approximately 0.030 may be implemented for the notch widths, notch spacings, and overall molding lengths. However, the notch depth may benefit from having a minimum depth of 0.300 inches with a maximum overcut of 0.010 inches.

As shown in FIG. 4, main piece molding 400 may be butt cut on the end 408 to allow the main piece molding 400 to abut facing ends of other main piece moldings or to abut vertical sides 207, 228, 250, or 270 of perimeter piece moldings. Bottom edge 136' may be flush with the lower edges of other molding pieces in the ceiling assembly.

Figure 5A:
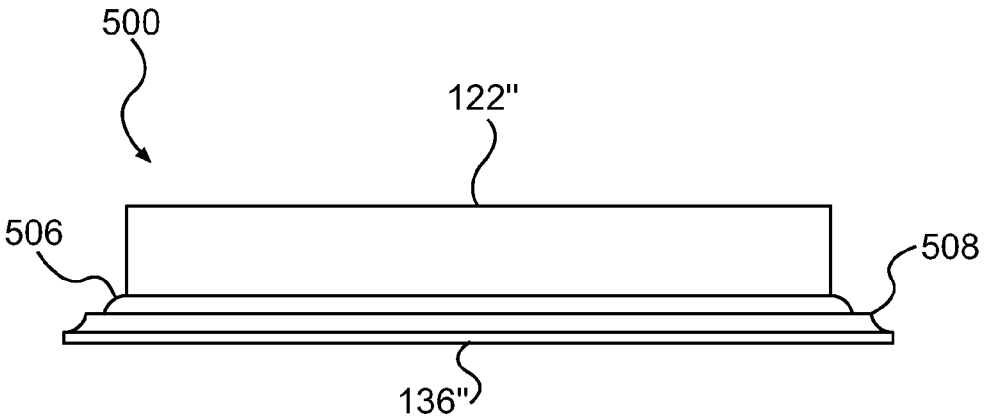
FIG. 5A is a side view of a first cross piece molding for spanning between parallel main piece moldings.

FIG. 5A shows an example of a side view of a cross piece molding 500. Upper edge 122" does not include notches since the cross piece molding 500 typically spans between parallel main piece moldings 400, which are typically a set distance apart. First end 506 and second end 508 are formed with coped ends to smoothly abut the decorative pattern of main piece moldings 400. The coping may follow an inverse of the decorative portion pattern that allows first end 506 and second end 508 to receive a face of the decorative portion. Bottom edge 136" is also at a vertical distance that is flush with other lower edges of other molding pieces in the ceiling assembly.

Figure 5B:
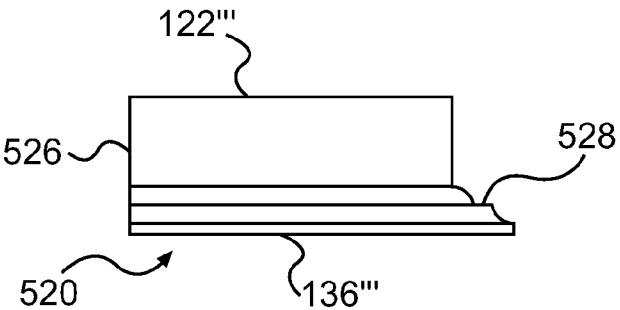
FIG. 5B is a side view of a second cross piece molding for spanning between a perimeter molding and a main piece molding.

FIG. 5B shows a side view of a peripheral cross piece molding 520. Upper edge 122''' does not include notches since the cross piece molding 500 typically spans between a main piece molding 400 and a perimeter molding, such as third perimeter molding 240. The peripheral cross piece molding 520 typically spans between overlaps of suspension hardware, such as the joint formed when an L-bar intersects with a T-bar, or when a cross T-bar intersects with a main T-bar.

First end 526 is formed with a butt cut end to smoothly abut a perimeter molding. The butt cut end may be formed during installation of the peripheral cross piece molding 520 since the distance between main piece moldings 400 and perimeter moldings 200, 220, 240, or 260 may vary. In addition, two peripheral cross piece moldings 520 may be abutted at their butt cut ends to span a section between main piece moldings 400.

Second end 528 is formed with a coped end to smoothly abut the decorative pattern of main piece moldings 400. The coping may follow an inverse of the decorative pattern that allows second end 528 to receive a face of the decorative portion. Bottom edge 136''' is at a vertical distance that is flush with other lower edges of other molding pieces in the ceiling assembly.

Figure 6:
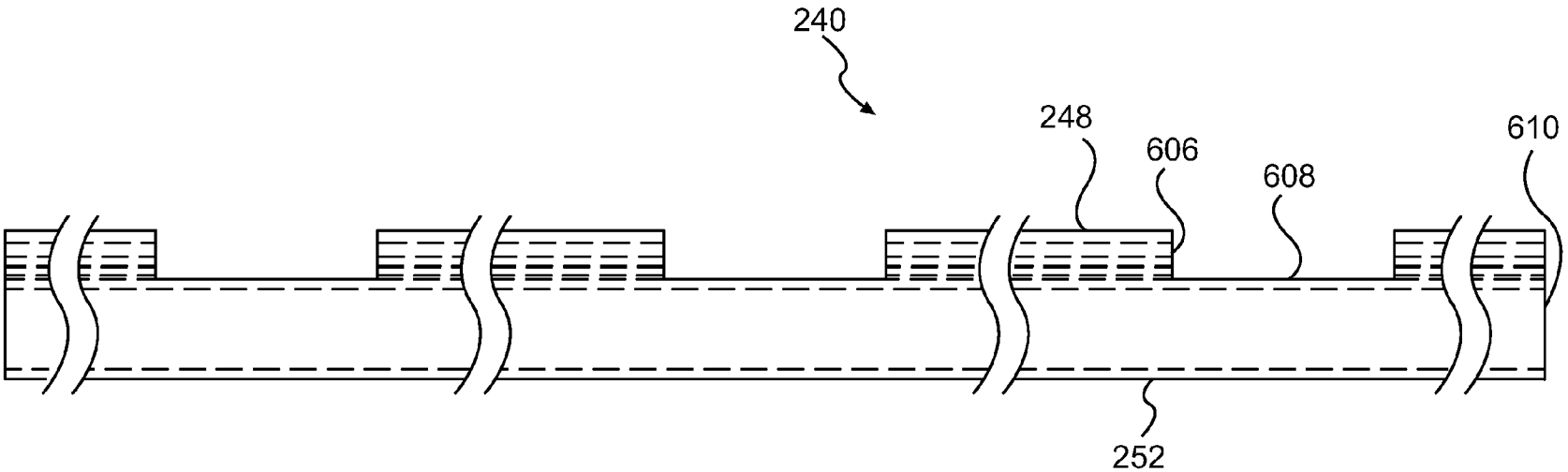
FIG. 6 is a side view of a perimeter molding.

FIG. 6 shows an example of a side view of a perimeter molding, such as third perimeter molding 240. As an example, the perimeter molding 240 may be approximately six feet in length. An upper edge, formed by second horizontal arm 248 includes spaced notches 608 that also cut into vertical side 250. The notches 608 are spaced at sufficient distances to accommodate the overlap areas of perimeter wall runner grids with cross T grids, which may comprise interfitting L-bars and T-bars. The depth of notches 608 should be sufficient to accept the overlap areas without affecting the grip of the snap-on assembly. Or, in the case of first and second perimeter molding designs 200 and 220, the depth of the notches 608 should not interfere with the cooperation of respective vertical and horizontal arms. The notches may be formed, for example, by a dado blade.

As one non-limiting example, the perimeter molding may have the following dimensions. The material thickness may be 0.060+/−0.005 inches. The depth of the notch along notch wall 606 may be approximately 0.245 inches. First notches may be approximately 11.438 inches from opposing ends of the six foot length. At least one additional notch may be spaced 22.875 inches away from the inner ends of the first notches, while the notches may be 1.125 inches in width. A reasonable engineering tolerance of approximately 0.030 may be implemented for the notch widths, notch spacings, and overall molding lengths. However, the notch depth may benefit from having a minimum depth of 0.300 inches with a maximum overcut of 0.010 inches.

As shown in FIG. 6, perimeter piece molding 240 may be butt cut on the end 610 in order to abut facing ends of other perimeter piece moldings or to abut butt cut ends 526 of peripheral piece moldings. Lower edge, here formed by third horizontal surface 252, may be flush with the lower edges of other molding pieces in the ceiling assembly.

Figure 7:
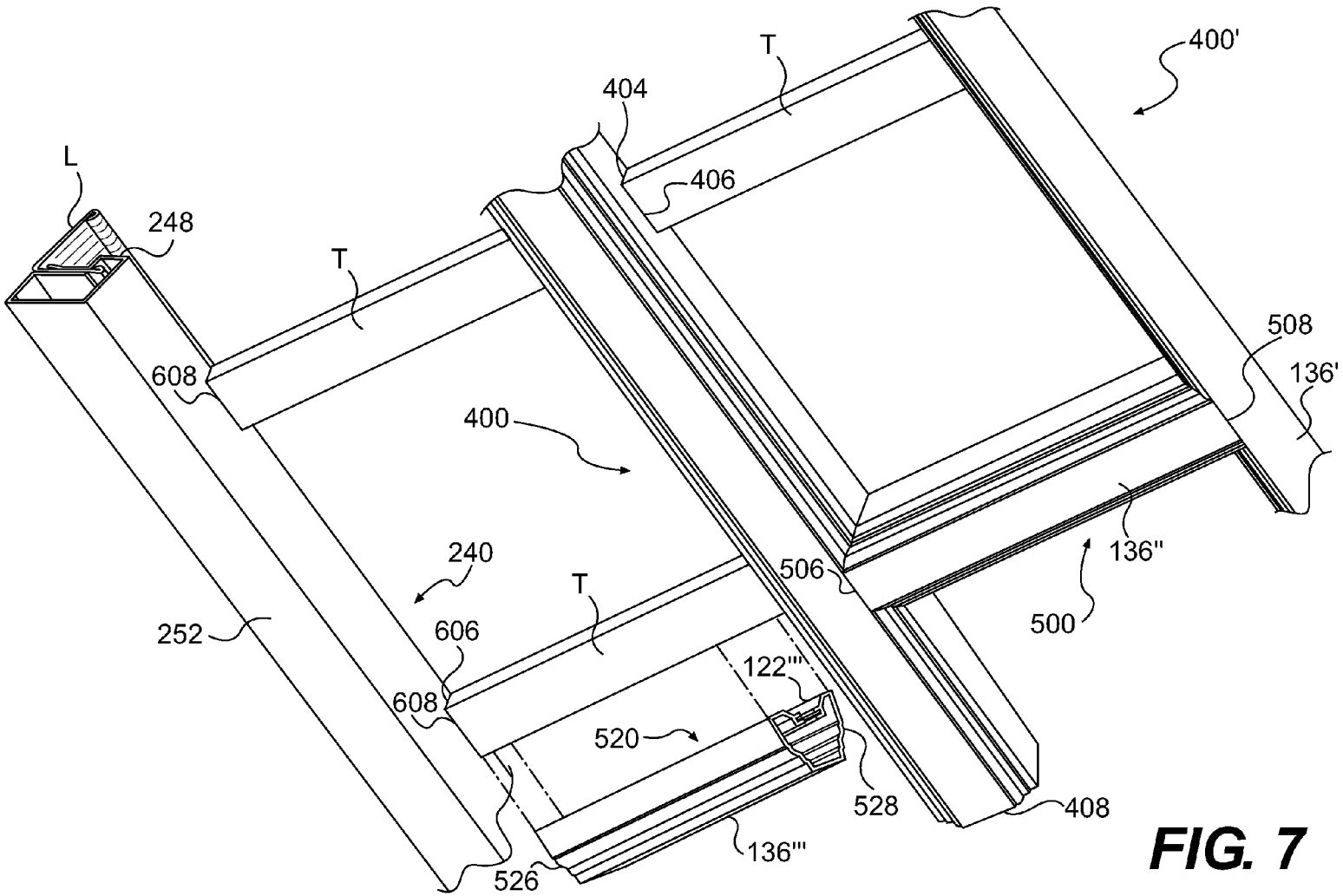
FIG. 7 is an example of an L-bar and T-bar drop ceiling assembly having a perimeter molding, two main piece moldings, a first cross piece molding, and a second cross piece molding.

FIG. 7 shows an example of a ceiling assembly in the process of installation. For simplicity, installed tiles, walls, and suspension means for T-bars are not shown.

In the example of FIG. 7, third perimeter piece molding 240 is snap-fit to L-bar L. Upper surface, at second horizontal arm 248, extends upwards into the area concealed by the ceiling assembly. Lower edge, formed by third horizontal arm 252, faces downward from the ceiling assembly.

Notches 608 permit T-bar T to pass through a portion of perimeter molding. Notch wall 606 abuts T-bar T, or is reasonably close to prevent a visual gap in the final installation.

The exterior of perimeter piece molding 240 is shown with substantially flat surfaces to allow butt cut ends of other perimeter piece moldings to abut the exterior. Butt cut ends of peripheral piece moldings 520 may also smoothly abut the flat surfaces of perimeter piece molding 240.

FIG. 7 shows a peripheral piece molding 520 in the process of being installed. Upper surface 122''' will extend upwards into the area concealed by the ceiling assembly. Bottom edge 136''' will face downward from the ceiling assembly. First butt cut end 526 will abut vertical side 250 of perimeter molding and second coped end 528 will abut a portion of main piece molding 400. Butt cut end 408 may, in other embodiments, connect to other portions of a ceiling assembly.

For instance, the length of peripheral piece molding 520 may be cut to a custom length to accommodate non-uniformly cut tiles or custom-cut tiles, such as may occur at the edges of a ceiling installation. The butt cut end 408 may abut a perimeter molding, or it may abut another butt cut end of a peripheral piece molding to accommodate a custom tile size in between main ceiling grids.

Cross piece molding 500 extends between first main piece molding 400 and second main piece molding 400'. First coped end 506 abuts first main piece molding 400, and second coped end 508 abuts second main piece molding 400'. Bottom edge 136'' faces downward in the ceiling assembly.

FIG. 7 also shows a T-bar T extending through a notch in first main piece molding 400 and a notch 406 in second main piece molding. Notch wall 404 abuts T-bar T, or is reasonably close to prevent a visual gap in the final installation.

Turning now to formation methods for the molding system, while other formation methods may be used, the decorative molding may be extruded against a die to create a one-piece molding unit. The material for the molding may comprise composite wood, a synthetic composite, or a plastic such as PVC.

While the groove for the clip assemblies may be created during the molding process, the groove can be formed more precisely by cutting or etching the groove into the extruded molding to form the clip assembly.

The main piece molding can be fabricated to custom length, or it can be created to longer lengths and cut down to appropriate sizes, such as by sawing. For example, the main piece molding may be extruded to an initial 73 inch length and processed to create the clip assembly. Several pieces, for example, five, may be placed into a machining nest and fed into a set of saws that cut the extruded grooved pieces down to a 72 inch finished length. Simultaneously, three dado blade sets, or other cutting tools, may also cut the required notches.

The cross-piece molding 500 may be cut from an extruded grooved piece to a finished length of, for example 23.13 inches. The piece may then be cycled back and forth between two aligned punch units, which are connected by a rail, to form the opposed coped first and second ends 506 and 508. Other alternatives are available to form the coped edges, such as a CNC machine equipped with a router bit, laser cutting, etc.

The peripheral edge molding 520 may be cut from an extruded grooved piece to a finished length of, for example 22.79 inches. The cutting may form a butt cut surface on butt cut end 526, and the piece may then be punched to form coped end 528. Other alternatives are available to form the coped end 528, such as a CNC machine equipped with a router bit, laser cutting, etc The perimeter molding can be fabricated to custom length, or it can be created to longer lengths and cut down to appropriate sizes, such as by sawing. For example, the perimeter molding may be extruded to an initial 73 inch length. Several pieces, for example, five, may be placed into a machining nest and fed into a set of saws that cut the extruded pieces down to a 72 inch finished length. Three dado blade sets, or other cutting tools, may then cut the required notches.

In the preceding specification, various preferred embodiments have been described with reference to the accompanying drawings. It will, however, be evident that various other modifications and changes may be made thereto, and additional embodiments may be implemented, without departing from the broader scope of the invention as set forth in the claims that follow. The specification and drawings are accordingly to be regarded in an illustrative rather than restrictive sense.

For instance, the dimensions of the moldings may be adjusted to accommodate two foot by four foot tiles, or other tile sizes. The adjustment would entail adjusting notch spacings and may entail adjusting the finished lengths of the moldings. Other gridwork configurations can also be accommodated, and the L-bar and T-bar shown are not meant to be limiting.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

We claim:

1. A clip on molding for concealing gridwork in suspended ceilings, the molding comprising:

a first clip assembly comprising:

a first arm having a first end and a second end;

a first finger protruding from the first arm, the first finger having at least one flat surface; and a second finger protruding from the second end of the first arm, the second finger having a surface parallel to the flat surface of the first finger;

a second clip assembly opposite to the first clip assembly, the second clip assembly comprising:

a second arm having a first end and a second end;

a third finger protruding from the second arm, the third finger having at least one flat surface; and a fourth finger protruding from the second end of the second arm, the fourth finger having a surface parallel to the flat surface of the third finger;

a third arm with a first end and a second end, the first end of the third arm extending from the first end of the first arm, the third arm parallel to the flat surface of the first finger;

a fourth arm with a first end and a second end, the first end of the fourth arm extending from the first end of the second arm, the fourth arm parallel to the flat surface of the third finger; and a decorative portion spanning between the second end of the third arm and the second end of the fourth arm, wherein the first finger and the second finger extend away from the first arm and towards the third finger and the fourth finger, and the third finger and the fourth finger extend away from the second arm and towards the first finger and the second finger, and whereby, when the molding is mounted to gridwork, edges of the gridwork are held between the first, second, third and fourth fingers.

2. The molding of claim 1, wherein the first arm and the second arm are parallel.

3. The molding of claim 1, wherein the first arm is oblique with respect to the flat surface of the first finger and the third arm, and the second arm is oblique with respect to the flat surface of the third finger and the fourth arm.

4. The molding of claim 1, wherein the first finger has a surface that is oblique with respect its flat surface and the third finger has a surface that is oblique with respect to its flat surface.

5. The molding of claim 1, wherein the third and fourth arms are configured to accept tensile loads and to transfer pressures to respective first and second clip assemblies.

6. The molding of claim 1, wherein the second finger protrudes farther from the first arm than the first finger and wherein the fourth finger protrudes farther from the second arm than the third finger.

7. The molding of claim 1, wherein the molding extends longitudinally to create parallel longitudinal grooves configured to attach to longitudinally extending gridwork.

8. The molding of claim 7, wherein the longitudinally extending gridwork intersects laterally extending gridwork, and the molding further comprises spaced notches configured to receive portions of laterally extending gridwork.

9. The molding of claim 7, further comprising coped end portions at opposed longitudinal ends, the coping configured to receive an inverse pattern of the decorative portion.

10. The molding of claim 7, further comprising opposed longitudinal ends, a first longitudinal end comprising a coped end and a second longitudinal end comprising a butt cut end.

11. A snap-on molding for concealing gridwork in suspended ceilings, the molding comprising:

a first arm with a first end and a second end;

a second arm connected to the first end of the first arm, the second arm perpendicular to the first arm;

a third arm connected to the second end of the first arm the third arm parallel to the second arm;

a fourth arm connected to first arm, the fourth arm parallel to the second arm and extending away from the first arm in the same direction as the second arm;

a fifth arm connected to the third arm, the fifth arm parallel to the first arm;

a sixth arm connected to the fifth arm, the sixth arm parallel to the second arm; and a seventh arm with a first end and a free distal end, the seventh arm parallel to the first arm, whereby, when the molding is mounted to gridwork, a portion of the gridwork interposes the second arm and the seventh arm.

12. The molding of claim 11, wherein the fourth arm is between the second arm and the third arm.

13. The molding of claim 11, wherein the second arm and the fourth arm extend toward the fifth arm.

14. The molding of claim 11, further comprising an eighth arm connected to the fifth arm, the eighth arm parallel to and opposite to the fourth arm, whereby, when the molding is mounted to gridwork, a portion of the gridwork interposes the fourth arm and the eighth arm.

15. The molding of claim 14, whereby, when the molding is mounted to gridwork, the fourth arm and the eighth arm retain a hem of the gridwork.

16. A snap-on molding for concealing gridwork in suspended ceilings, the molding comprising:

a first arm with a first end and a second end;

a second arm connected obliquely to the first end of the first arm;

a third arm connected to the second end of the first arm;

a fourth arm connected to the third arm, the fourth arm parallel to the first arm;

a fifth arm connected to the fourth arm, the fifth arm perpendicular to the fourth arm;

a sixth arm connected to the fifth arm, the sixth arm parallel to the fourth arm;

a seventh arm connected to the sixth arm, the seventh arm parallel to the fifth arm; and an eighth arm with a first end and a free distal end, the first end connected to the seventh arm, the eighth arm parallel to the first arm, whereby, when the molding is mounted to gridwork, a portion of the gridwork is between the first arm and the eighth arm.

17. The molding of claim 16, wherein the third arm is parallel to the fifth arm.

18. The molding of claim 16, wherein the third arm is oblique with respect to the first arm, and the second arm and the third arm are oppositely oblique.

19. The molding of claim 16, whereby, when the molding is mounted to gridwork, the third arm and the seventh arm retain a hem of the gridwork.

20. The molding of claim 16, further comprising a ninth arm having a free distal end, the ninth arm connected to the sixth arm and the ninth arm parallel to the fifth arm.

21. The molding of claim 11, wherein at least one of the third arm and the fifth arm is decorative.

22. The molding of claim 16, wherein at least one of the fifth arm and the sixth arm is decorative.

* * * * *

UNITED STATES PATENT AND TRADEMARK OFFICE

CERTIFICATE OF CORRECTION

PATENT NO. : 8,176,700 B2
APPLICATION NO. : 12/755871
DATED : May 15, 2012
INVENTOR(S) : William V. Butcher, Jr. et al.

It is certified that error appears in the above-identified patent and that said Letters Patent is hereby corrected as shown below:

On page 1, at column 1, lines 5-6, "Kevin R. Albright" should read --Kevin L. Albright--.

Signed and Sealed this
Twenty-fourth Day of July, 2012

David J. Kappos

David J. Kappos
*Director of the United States Patent and Trademark Office*